US006675732B2

(12) United States Patent
Orr

(10) Patent No.: US 6,675,732 B2
(45) Date of Patent: Jan. 13, 2004

(54) SPONSON FOR WATERCRAFT

(75) Inventor: Bill Orr, Fountain Valley, CA (US)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 79 days.

(21) Appl. No.: 09/950,002

(22) Filed: Sep. 12, 2001

(65) Prior Publication Data

US 2002/0033128 A1 Mar. 21, 2002

Related U.S. Application Data

(60) Provisional application No. 60/232,062, filed on Sep. 12, 2000.

(51) Int. Cl.[7] ..... B63B 43/14
(52) U.S. Cl. ..... 114/123; 114/292
(58) Field of Search ..... 114/123, 292, 114/288, 283, 67 R

(56) References Cited

U.S. PATENT DOCUMENTS

| | | | | |
|---|---|---|---|---|
| 2,544,599 A | * | 3/1951 | Keelen | 114/123 |
| 2,677,139 A | | 5/1954 | Canazzi | |
| 2,848,725 A | | 8/1958 | Shoulin | |
| 3,045,629 A | | 7/1962 | Farrington | |
| 3,450,084 A | * | 6/1969 | Gerbracht | 114/123 |
| 4,416,639 A | | 11/1983 | Gillmer | |
| 5,050,517 A | * | 9/1991 | Kobayashi | 114/123 |
| 5,611,295 A | | 3/1997 | Stables | |
| 5,706,751 A | | 1/1998 | Hodges | 114/219 |
| 5,713,297 A | | 2/1998 | Tani et al. | |
| 5,908,006 A | | 6/1999 | Ibata | 114/284 |
| 6,032,605 A | | 3/2000 | Takashima | |
| 6,058,873 A | | 5/2000 | Koyanagi | |
| 6,105,527 A | | 8/2000 | Lochtefeld et al. | |

FOREIGN PATENT DOCUMENTS

| | | |
|---|---|---|
| GB | 592017 | 9/1947 |
| JP | 6-191466 | 12/1994 |

OTHER PUBLICATIONS

Uffa, Fox, "Bluebird Reflection", Motor Boat and Yachting, vol. 108, No. 2302, Jun. 28, 1968, pp. 52–53.

* cited by examiner

*Primary Examiner*—Sherman Basinger
(74) *Attorney, Agent, or Firm*—Morgan, Lewis & Bockius LLP; Mark E. Duell

(57) ABSTRACT

A sponson for a watercraft includes a nose; a trailing end; and a base extending between the nose and the trailing end; wherein the base is non-linear in shape in a direction from the nose to the trailing end. The sponson can include an outboard surface extending between the nose and the trailing end; wherein the outboard surface is configured to reduce the water pressure during cornering.

27 Claims, 3 Drawing Sheets

SPONSON FOR WATERCRAFT

This application claims priority of now abandoned provisional application(s) No. 60/232,062 filed on Sep. 12, 2000, which is incorporated by reference.

BACKGROUND OF THE INVENTION

1. Field of the Invention

The present invention relates to a watercraft and more particularly, to a sponson for a watercraft.

2. Discussion of the Related Art

Sponsons are fitted onto watercraft to improve stability both at high speeds and during turning. The stability of the watercraft at high speed is dependent on the hull area in contact with the water. The sponsons increase the effective hull area when the watercraft is up on plane while at high speed. Thus, high speed stability is improved.

The location of the sponson on the hull is such that, during a turn, the inside sponson is below the waterline. The sponson projects outwardly and downwardly from the hull and causes the sponson to hydrodynamically bite into the water. This allows the watercraft to be banked more during a turn thus improving the cornering performance of the watercraft.

The transom of a conventional watercraft is flat as viewed in the longitudinal direction of the watercraft. This necessitates a linear base on the sponson. This geometry places a limit on the stability and maximum performance of the watercraft.

Although the sponson increases the amount by which the watercraft can be banked during cornering, the mere function of the sponson, i.e., biting into the water, limits the maximum amount by which the watercraft can be banked. Skilled operators can maintain control of the watercraft beyond this maximum. These operators will not recognize the increased performance as sufficient.

SUMMARY OF THE INVENTION

Accordingly, the present invention is directed to a sponson for a watercraft that substantially obviates one or more of the problems due to limitations and disadvantages of the related art.

An object of the present invention is to provide a watercraft with improved performance and stability under all conditions.

Another object of the present invention is to provide a watercraft with reduced drag and increased responsiveness.

Another object of the present invention is to provide a watercraft with reduced planing drag.

Another object of the present invention is to provide a watercraft with reduced drag while in reverse.

Another object of the present invention is to provide a watercraft with reduced unpredictability of a spinout while cornering.

Another object of the present invention is to provide a watercraft with improved inside lean cornering grip, bank angles and linearity.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the sponson for a watercraft includes a nose; a trailing end; and a base extending between the nose and the trailing end; wherein the base is non-linear in shape in a direction from the nose to the trailing end.

In another aspect, a sponson for a watercraft includes: a nose; a trailing end; and an outboard surface extending between the nose and the trailing end; wherein the outboard surface is configured to reduce the water pressure on the outboard surface during cornering.

In a further aspect, a watercraft includes: a hull having: a bow; a stern including a non-linear transom; and two sides extending from the bow to the stern; and a sponson attached to each of the sides of the hull along the transom; wherein the sponson has a non-linear base that matingly engages the non-linear transom.

In a further aspect, a watercraft includes: a hull having: a bow; a stern including a transom; and two sides extending from the bow to the stern; and a sponson attached to each of the sides of the hull along the transom, wherein the sponson includes: a nose; a trailing end; and an outboard surface extending between the nose and the trailing end; wherein the outboard surface is configured to reduce water pressure on the outboard surface during cornering of the watercraft.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
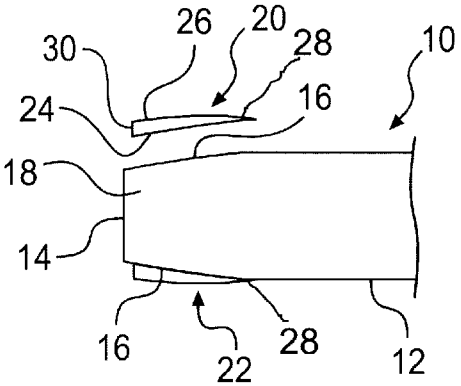
FIG. 1 is a schematic of a portion of the hull of a watercraft according to a first embodiment of the invention.

FIG. 1 shows a schematic of a watercraft 10 having a hull 12, a bow (not shown) and a stern 14. The side portions 16 of the hull 12 in the area of the transom 18 are each nonlinear in shape when viewed in the longitudinal direction of the watercraft 10.

The non-linear side portions 16 perform several functions. First, planing drag is reduced as compared to a conventional transom, which has flat side portions. This allows greater top end speed. Second, drag is reduced when the watercraft 10 is driven in reverse as compared to a conventional transom.

Sponsons 20, 22 are mounted on the hull 12 along the side portions 16. The right sponson 22 is a mirror image of the left sponson 20. Accordingly, only the left sponson 20 will be described in detail with reference to FIG. 1.

The sponson 20 has base 24 that abuts the side portion 16. The base 24 has a non-linear shape corresponding to that of the side portion 16. An outboard side 26 is opposite the base 24. The base 24 and the outboard side 26 meet at the leading end of the sponson 20 and define a nose 28. The base 24 and the outboard side 26 diverge as they extend toward a trailing end 30 of the sponson 20.

The sponsons 20, 22 can be secured to the hull 12 by a plurality of fasteners (not shown). Alternatively, the sponsons 20, 22 can be integrally formed with the hull 12 or the sponsons 20, 22 can be bonded to the hull.

FIGS. 2–6 illustrate a second embodiment of the invention. Only the sponson for the left side of the watercraft is described in detail, with the sponson for the right side being a mirror image of the left side sponson.

Figure 6:
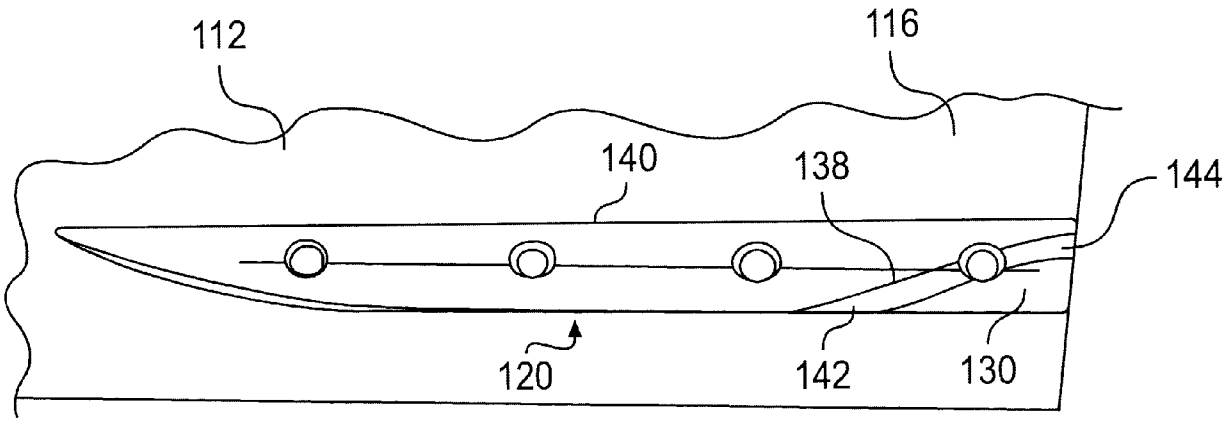
FIG. 6 is side view of a portion of a watercraft hull with the sponson shown in FIG. 2.

Referring to FIG. 6, the sponson 120 has base 124 that abuts the side portion 116 of the hull 112. The base 124 has a shape corresponding to that of the side portion 116. The base 124 and the side portion 116 can be linear or non-linear in shape. An outboard side 126 is opposite the base 124. The base 124 and the outboard side 126 meet at the leading end of the sponson 120 and define a nose 128. The base 124 and the outboard side diverge as they extend toward a trailing end 130 of the sponson 120.

Figure 4:
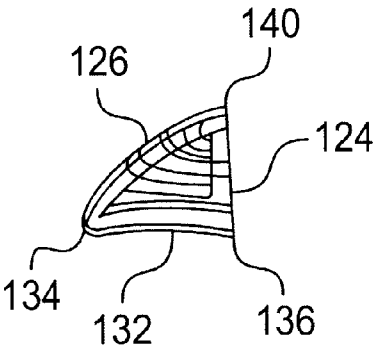
FIG. 4 is an end view of the sponson shown in FIG. 2.

As shown in FIG. 4, the sponson 120 includes a bottom surface 132 bordering the base 124 at an inboard edge 134 and bordering the outboard side 126 at an outboard edge 136.

Figure 2:
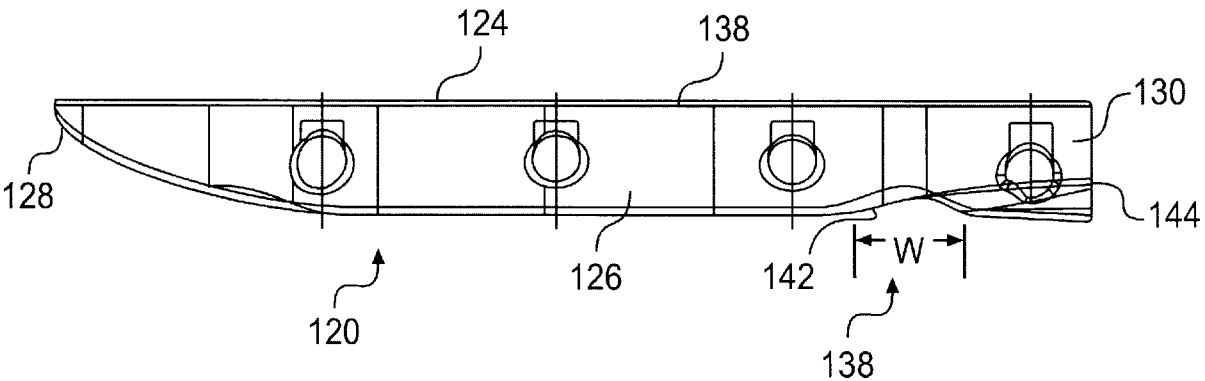
FIG. 2 is a top view of a sponson according to a second embodiment of the invention.
Figure 3:
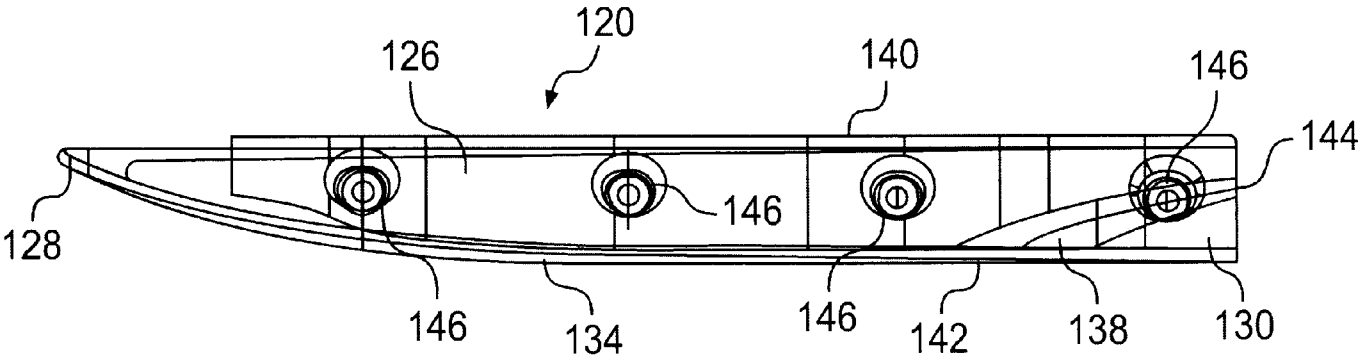
FIG. 3 is a side view of the sponson shown in FIG. 2.
Figure 5:
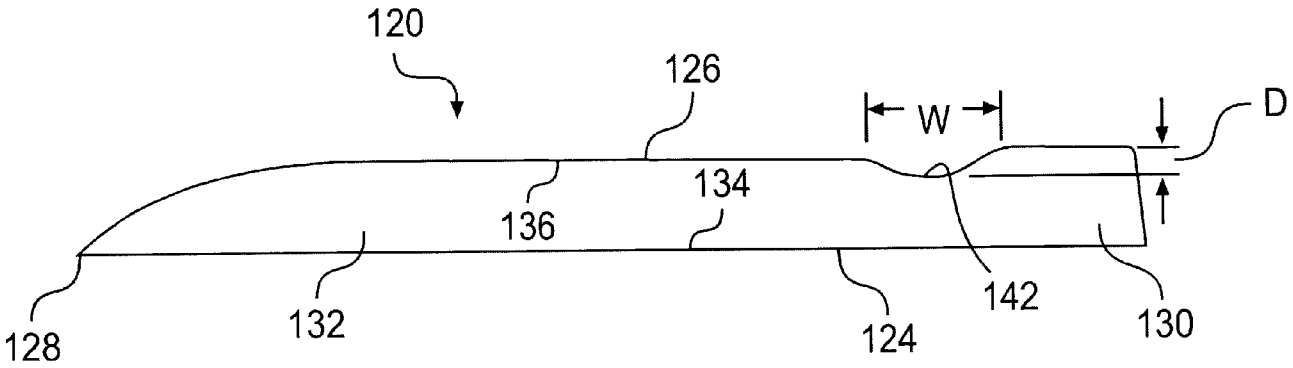
FIG. 5 is bottom view of the sponson shown in FIG. 2.

FIGS. 2–6 illustrate a channel 138 formed in the outboard side 126 adjacent the trailing end 130. FIGS. 3, 4 and 6 show the channel 138 extending obliquely from the outboard edge 136 toward a top edge 140 of the sponson 120. The channel 138 includes an inlet 142 extending across a portion of the outboard side 126 and the bottom surface 132 and an outlet 144 formed in the trailing end 130. Referring to FIGS. 2 and 5, the inlet 142 is radiused to provide a smooth passage for water to enter the channel 138.

The channel 138 decreases the water pressure on the bottom side of the sponson 120 when the watercraft is banked in a turn. This reduced water pressure allows the watercraft 10 to bank over more easily while maintaining an increased level of grip on the water.

FIGS. 2 and 3 illustrate that the cross-sectional area of the inlet 142 is greater than the cross-sectional area of the outlet 144. Referring to FIGS. 2 and 5, the width W of the inlet 142 as measured in the lengthwise direction of the sponson 120 is 90 mm and the depth D of the inlet 142 is 10 mm. Other dimensions are possible and determined by the size of the hull 112 and the sponson 120 and the desired pressure reduction of the water pressure due to the channel 138.

Other orientations of the channel 138 are possible, such as parallel to one of the edges 136, 140. The cross-sectional shape of channel 138 can be arcuate, square or any other geometry. The depth of the channel 138 may be constant or vary along its length. Instead of a channel, the trailing end 130 can be provided with a through bore.

In this second embodiment, the sponson 120 is secured to the hull 112 by a plurality of fasteners 146. The sponson 120 can be secured to the hull 112 by other means such as bonding and integrally forming the sponson 120 and the hull 112.

It will be apparent to those skilled in the art that various modifications and variations can be made in the sponson for a watercraft of the present invention without departing from the spirit or scope of the invention. Thus, it is intended that the present invention cover the modifications and variations of this invention provided they come within the scope of the appended claims and their equivalents.

What is claimed is:

1. A sponson for a watercraft, the watercraft including a hull having a surface area for contacting water in which the watercraft travels, the sponson comprising:

a nose;

a trailing end;

a base including a hull engaging surface extending in a curve from the nose to the trailing end, the hull engaging surface including a top edge; and a submergible surface extending outward from the top edge of the hull engaging surface that contacts the water and increases the surface area of the hull contacting the water when the watercraft travels through the water;

wherein the submergible surface further comprises means for reducing water pressure when the watercraft travels through the water.

2. A sponson for a watercraft, the watercraft including a hull having a surface area for contacting water in which the watercraft travels, the sponson comprising:

a nose;

a trailing end;

a base including a hull engaging surface extending in a curve from the nose to the trailing end, the hull engaging surface including a top edge; and a submergible surface extending outward from the top edge of the hull engaging surface that contacts the water and increases the surface area of the hull contacting the water when the watercraft travels through the water;

wherein the submergible surface includes a non-uniform configuration that reduces water pressure on the submergible surface when the watercraft travels through the water.

3. The sponson of claim 2, wherein the non-uniform configuration includes a channel adjacent the trailing end.

4. The sponson of claim 3, wherein the channel extends obliquely along a portion of the outboard submergible surface.

5. A sponson for a watercraft, the watercraft including a hull having a surface area for contacting water in which the watercraft travels, the sponson comprising:

a nose;

a trailing end; and a submergible surface extending between the nose and the trailing end that contacts the water and increases the surface area of the hull contacting the water when the watercraft travels through the water, and including a portion configured to reduce water pressure on the submergible surface when the watercraft travels through the water.

6. The sponson of claim 5, wherein the portion of the submergible surface comprises a channel adjacent the trailing end.

7. The sponson of claim 6, wherein the channel extends obliquely along the portion of the submergible surface.

8. The sponson of claim 6, further comprising a base including a top edge, a bottom edge, and a hull engaging surface extending from the bottom edge to the top edge;

the submergible surface further includes:

a bottom surface extending between the nose and the trailing end and extending outward from the bottom edge of the base; and an outboard surface extending outward from the top edge of the base to the bottom surface; and the channel extends obliquely from a portion of the outboard surface adjacent the bottom surface toward the top edge.

9. The sponson of claim 8, wherein the channel further comprises:

an inlet formed across a portion of the outboard surface and a portion of the bottom surface; and an outlet formed in the trailing end intermediate the bottom surface and the top edge.

10. The sponson of claim 9, wherein the inlet is larger than the outlet.

11. The sponson of claim 9, wherein the inlet is radiused at the junction with the bottom surface and the junction with the outboard surface.

12. The sponson of claim 5 further includes a curved base extending between the nose and the trailing end.

13. The sponson of claim 5, wherein the submergible surface further comprises:

a bottom surface extending between the nose and the trailing end; and an outboard surface extending between the nose and the trailing end;

wherein the outboard surface and the bottom surface lie submerged below a water surface when the watercraft is stationary in the water, the outboard surface lies above the water surface when the watercraft is travelling through the water along a straight path, and the outboard surface and the bottom surface lie below the water surface when the watercraft is travelling through the water along a curved path.

14. A watercraft comprises:

a hull having:

a bow;

a stem including a non-linear transom; and two sides extending from the bow to the stem; and a sponson attached to each of the sides of the hull along the transom and including:

a nose;

a trailing end;

a base including a hull engaging surface extending in a curve from the nose to the trailing end and engaging the non-linear transom, the hull engaging surface including a top edge; and a submergible surface extending outward from the top edge of the hull engaging surface that contacts the water and increases the surface area of the hull contacting the water when the watercraft travels through the water; and wherein the submergible surface extends between the nose and the trailing end, lies outboard of the base, and includes a channel.

15. The sponson of claim 14, wherein the channel is adjacent the trailing end.

16. The sponson of claim 15, wherein the channel extends obliquely along a portion of the outboard surface.

17. A watercraft comprises:

a hull having:

a bow;

a stem including a transom; and two sides extending from the bow to the stem; and a sponson attached to each of the sides of the hull along the transom and including:

a nose;

a trailing end; and a submergible surface extending between the nose and the trailing end that contacts the water and increases the surface area of the hull contacting the water when the watercraft travels through the water, the submergible surface including a portion configured to reduce water pressure on the submergible surface when the watercraft travels through the water.

18. The watercraft of claim 17, wherein the submergible surface further comprises a channel adjacent the trailing end.

19. The watercraft of claim 18, wherein the channel extends obliquely along a portion of the submergible surface.

20. The watercraft of claim 18, wherein the sponson further comprises a base including a top edge, a bottom edge, and a hull engaging surface extending from the bottom edge to the top edge and engaging the hull;

the submergible surface further includes: a bottom surface extending between the nose and the trailing end and extending outward from the bottom edge of the base; and an outboard surface extending outward from the top edge of the base to the bottom surface; and the channel extends obliquely from a portion of the outboard surface adjacent the bottom surface toward the top edge.

21. The watercraft of claim 20, the channel further comprises:

an inlet formed across a portion of the outboard surface and a portion of the bottom surface; and an outlet formed in the trailing end intermediate the bottom surface and the top edge.

22. The watercraft of claim 21, wherein the inlet is larger than the outlet.

23. The watercraft of claim 21, wherein the inlet is radiused at the junction with the bottom surface and the junction with the outboard surface.

24. The watercraft of claim 17, wherein the sides are curved along the transom; and the sponson further includes a curved base extending between the nose and the trailing end;

wherein the curvature of the base is complimentary to the curvature of the sides.

25. The watercraft of claim 17, wherein the submergible surface further comprises:

a bottom surface extending between the nose and the trailing end; and an outboard surface extending between the nose and the trailing end;

wherein the outboard surface and the bottom surface lie submerged below a water surface when the watercraft is stationary in the water, the outboard surface lies above the water surface when the watercraft is travelling through the water along a straight path, and the outboard surface and the bottom surface lie below the water surface when the watercraft is travelling through the water along a curved path.

26. A sponson for a watercraft, the watercraft including a hull having a surface area for contacting water in which the watercraft travels, the sponson comprising:

a nose;

a trailing end;

a base including a hull engaging surface extending in a curve from the nose to the trailing end, the hull engaging surface including a top edge; and a submergible surface extending outward from the top edge of the hull engaging surface that contacts the water and increases the surface area of the hull contacting the water when the watercraft travels through the water;

wherein the submergible surface further comprises:

a bottom surface extending between the nose and the trailing end; and an outboard surface extending between the nose and the trailing end;

wherein the outboard surface and the bottom surface lie submerged below a water surface when the watercraft is stationary in the water, the outboard surface lies above the water surface when the watercraft is travelling through the water along a straight path, and the outboard surface and the bottom surface lie below the water surface when the watercraft is travelling through the water along a curved path.

27. A watercraft comprises:

a hull having:

a bow;

a stem including a non-linear transom; and two sides extending from the bow to the stern; and a sponson attached to each of the sides of the hull along the transom and including:

a nose;

a trailing end;

a base including a hull engaging surface extending in a curve from the nose to the trailing end and engaging the non-linear transom, the hull engaging surface including a top edge; and a submergible surface extending outward from the top edge of the hull engaging surface that contacts the water and increases the surface area of the hull contacting the water when the watercraft travels through the water; and wherein the submergible surface further comprises:

a bottom surface extending between the nose and the trailing end; and an outboard surface extending between the nose and the trailing end;

wherein the outboard surface and the bottom surface lie submerged below a water surface when the watercraft is stationary in the water, the outboard surface lies above the water surface when the watercraft is travelling through the water along a straight path, and the outboard surface and the bottom surface lie below the water surface when the watercraft is travelling through the water along a curved path.

* * * * *